US006793684B1

(12) United States Patent
Jarvis et al.

(10) Patent No.: US 6,793,684 B1
(45) Date of Patent: Sep. 21, 2004

(54) FABRIC CARE COMPOSITION

(75) Inventors: Anthony Nicholas Jarvis, Wirral (GB); Andrew Philip Parker, Wirral (GB); Philip John Sams, Wirral (GB)

(73) Assignee: Unilever Home & Personal Care USA, division of Conopco, Inc., Chicago, IL (US)

( * ) Notice: Subject to any disclaimer, the term of this patent is extended or adjusted under 35 U.S.C. 154(b) by 90 days.

(21) Appl. No.: 10/089,615

(22) PCT Filed: Sep. 27, 2000

(86) PCT No.: PCT/EP00/09590

§ 371 (c)(1),
(2), (4) Date: Aug. 29, 2002

(87) PCT Pub. No.: WO01/25387

PCT Pub. Date: Apr. 12, 2001

(30) Foreign Application Priority Data

Oct. 1, 1999 (GB) ..... 9923280

(51) Int. Cl.[7] ..... D06M 13/46; D06M 15/00; C11D 1/62; C11D 3/37

(52) U.S. Cl. ..... 8/116.1; 8/181; 8/188; 510/276; 510/292; 510/327; 510/330; 510/475; 510/499; 510/504

(58) Field of Search ..... 8/116.1, 181, 188; 510/276, 292, 327, 330, 475, 499, 504

(56) References Cited

U.S. PATENT DOCUMENTS

| | | | | |
|---|---|---|---|---|
| 4,032,565 A | | 6/1977 | Kilpatrick et al. | |
| 4,039,517 A | | 8/1977 | Hamamura et al. | |
| 4,137,180 A | | 1/1979 | Naik et al. | |
| 4,191,802 A | | 3/1980 | Guise et al. | |
| 4,520,143 A | | 5/1985 | Jellinek | |
| 4,631,226 A | | 12/1986 | Jellinek | |
| 5,595,572 A | | 1/1997 | Millington | |
| 2001/0034316 A1 | * | 10/2001 | Carswell et al. | 510/327 |

FOREIGN PATENT DOCUMENTS

| | | | | |
|---|---|---|---|---|
| EP | 0 335 404 | | 10/1989 | |
| EP | 0 537 578 A2 | | 4/1993 | |
| EP | 0 537 678 A2 | | 4/1993 | |
| EP | 0 829 531 A1 | | 3/1998 | |
| EP | WO 01/63037 | * | 8/2001 | D06M/15/00 |
| GB | 2 005322 | | 4/1979 | |
| GB | 2005322 | * | 4/1979 | D06M/15/00 |
| GB | 1 549 180 | | 7/1979 | |
| GB | 2 039 556 | | 8/1980 | |
| GB | 2 202 244 A | | 9/1988 | |
| WO | 94/19526 | | 9/1994 | |
| WO | 98/16538 | | 4/1998 | |

OTHER PUBLICATIONS

Patents Act 1977 Search Report under Section 17 (GB 9923280.3) Dec. 13, 1999.

International Search Report (PCT/EP 00/09590) Jan. 16, 2001.

* cited by examiner

*Primary Examiner*—Brian P. Mruk
(74) *Attorney, Agent, or Firm*—Alan A. Bornstein

(57) ABSTRACT

A fabric care composition, which is adapted for use in a domestic laundering process, comprises an anionic polymer which is capable of self cross-linking and/or of reacting with cellulosic fibers, such as cotton, and a textile compatible exhaustion agent which is also a fabric conditioner. The polymer may be a carbamoyl sulphonate terminated poly (ether) urethane or a bunte salt terminated polymer. The polymers can increase the dimensional stability of the fabric, improve its surface color definition after washing, impart a softer handle and improve its crease recovery properties.

7 Claims, No Drawings

FABRIC CARE COMPOSITION

This invention relates to a fabric care composition, to a method of treating a fabric using the composition and to the use of anionic polymers contained in the composition to improve certain properties of fabrics.

The laundry process generally has several benefits for fabric, the most common being to remove dirt and stains from the fabric during the wash cycle and to soften the fabric during the rinse cycle. However, there are numerous disadvantages associated with repeated use of conventional laundry treatment compositions and/or the actual laundry process; one of these being a fairly harsh treatment of fabric in the laundry process.

Fabrics can be damaged in several ways as a result of repeated laundering and/or wear. Fabric pilling and loss of fabric surface appearance eg fuzzing, shrinkage (or expansion), loss of colour from the fabric or running of colour on the fabric (usually termed dye transfer) are some of the common problems associated with repeated laundering. These problems may occur merely from repeated hand washing as well as the more vigorous machine washing process. Furthermore, problems relating to damage of fabric over time through normal use, such as loss of shape and increased likelihood of wrinkling are also significant.

The treatment of woollen textiles with curable anionic polymers by exhaustion onto the fabric is described in GB-A-2005322. The treatment is said to confer shrink resistence on wool and other keratinous materials. The process taught for the treatment involves a short liquor processing apparatus capable of agitating the goods and, although washing machines are described as being suitable for this purpose, there is no mention of domestic laundering processes. Indeed, the processes disclosed are industrial, being carried out in milling machines, for example.

Industrial treatments of a range of fabrics by padding an anionic polymer onto the fabric are disclosed in U.S. Pat. No. 4,191,802. The polymer is directly padded on to the fabric in the process described. The process is applied industrially to fabrics containing cotton with claimed advantages of reduced shrinkage and creasing. The treatment is described as having no effect on handle of the fabric. Similar industrial treatments of wool are described in U.S. Pat. No. 4,520,143, U.S. Pat. No. 4,631,226, U.S. Pat. No. 5,595,572, WO 94/19526 and U.S. Pat. No. 4,032,565.

The industrial treatment of fabrics with thermo-reactive urethanes is taught in U.S. Pat. No. 4,039,517. The polymers require a high temperature curing step at greater than 100° C. and such high temperature curing is common for industrial processes.

The treatment of fabrics with blocked polyisocyanates is described in EP-A-0537578.

The present invention aims to alleviate some of the disadvantages associated with the laundry process. In particular, the invention seeks to attain advantages in fabric treatment as part of a conventional laundry process.

The advantages include increased dimensional stability of the fabric.

The present invention also seeks to improve the surface colour definition and/or the handle of the fabric in both industrial textile treatment processes and in small and large scale laundering processes.

According to the present invention, there is provided a fabric care composition, adapted for use in a laundering process, comprising an anionic polymer which is capable of self cross-linking and/or reacting with cellulosic fibres and further comprising a fabric conditioning agent which acts as a textile compatible exhaustion agent for the anionic polymer, and which comprises one or more cationic groups.

Surprisingly, the anionic polymers can impart benefits to fabrics containing cellulosic fibres (such as cotton) in a laundering process. The benefits include increased dimensional stability and/or improved surface colour definition and/or softer handle. The dimensional stability of a fabric is generally a measure of its resistance to shrinkage. However, the term "dimensional stability", and related terms, used herein covers not only shrinkage of fabrics but also shape retention, bagginess reduction and additionally, although less preferred, crease/wrinkle resistance in fabrics.

Preferably, the anionic polymer is selected from carbamoyl sulphonate terminated poly(ether)urethane resins, bunte salt terminated polymers and mixtures thereof. Suitable polymers include those having the formula (I):

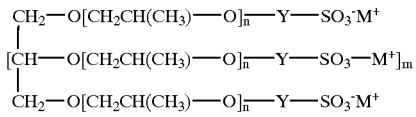

(I)

wherein:

Y is a divalent radical selected from $—CH_2—CH(OH)—CH_2—S—$ and $—CO—NH—(CH_2)_p—NH—CO—$;

m is an integer from 0 to 4;

n is an integer from 5 to 20;

M is an alkali metal; and p is an integer from 2 to 12.

Preferably, m is equal to 1.

Conveniently, Y is $—CO—NH—(CH_2)_p—NH—CO—$ and, preferably, p is from 4 to 8, such as about 6.

It is also preferred that n is 10 to 15, such as about 13, for example.

M is advantageously sodium or potassium, more preferably sodium.

Polymers in which Y is $—CO—NH—(CH_2)_p—NH—CO—$ are commercially available under the Trade Mark SYNTHAPPRET BAP (Bayer). Polymers in which Y is $—CH_2—CH(OH)—CH_2—S—$ are available under the Trade Mark NOPCOLAN SHR3 (Henkel).

Conditioning/exhaustion agents which are suitable for use in the compositions of the invention include water soluble or water dispersible compounds comprising one or more quaternary ammonium cations.

Preferrred materials include HEQ (1,2-bis-[hardened tallowoyloxy]-3-trimethylammonium propane chloride), for example.

In the present invention, quaternary ammonium cations such as HEQ have the dual function of acting as both exhaustion agents and as fabric conditioning/softening compounds, as described hereinafter.

Optionally, other cationic species, which do not act as fabric softening compounds, such as other predominantly organic cations and simple metal cations (eg magnesium), for example, may also be used as additional exhaustion agents in the fabric care compositions of the invention. The compositions of the invention may contain one textile compatible exhaustion agent or a mixture of two or more textile compatible exhaustion agents.

Softening and/or conditioning compounds which are not exhaustion agents are optional further components of the compositions of the invention.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the fabric in the tumble dryer if used in a suitable form. Thus, another product form is a composition (for example, a paste) suitable for coating onto, and delivery from, a substrate eg a flexible sheet or sponge or a suitable dispenser (such as a container having apertures therein, for example) during a tumble dryer cycle.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above.

It is preferred if the long chain alkyl or alkenyl groups of the fabric softening compound are predominantly linear.

Quaternary ammonium compounds having two long-chain aliphatic groups, for example distearyldimethyl ammonium chloride and di (hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337). Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12-22}$ alkyl or alkenyl groups connected to the molecule via at least one ester link, preferably two ester links. An especially preferred ester-linked quaternary ammonium material can be represented by the formula II: wherein each RI group is independently selected from $C_{1-4}$ (II)

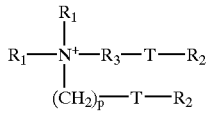

alkyl or hydroxyalkyl groups or $C_{2-4}$ alkenyl groups; each $R_2$ group is independently selected from $C_{8-28}$ alkyl or alkenyl groups; and wherein —$R_3$— is a linear or branched alkylene group of 1 to 5 carbon atoms, T is

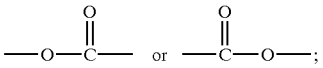

and p is 0 or is an integer from 1 to 5.

Di (tallowoyloxyethyl) dimethyl ammonium chloride and/or its hardened tallow analogue is especially preferred of the compounds of formula (II).

A second preferred type of quaternary ammonium material can be represented by the formula (III):

(III)

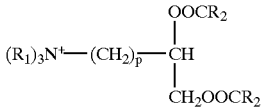

wherein $R_1$, p and $R_2$ are as defined above.

It is advantageous if the quaternary ammonium material is biologically biodegradable.

Preferred materials of this class such as 1,2-bis (hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1966, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

Other suitable softeners include liquid or soft solid sugar esters of the type described in WO 98/16538, for example.

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof. Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions may include silicones, such as predominantly linear polydialkylsiloxanes, eg polydimethylsiloxanes or amino-silicones containing amine-functionalised side chains; soil release polymers such as block copolymers of polyethylene oxide and terephthalate; amphoteric surfactants; smectite type inorganic clays; zwitterionic quaternary ammonium compounds; and nonionic surfactants. Preferably, the silicone component is a dimethylpolysiloxane with aminoalkyl groups.

The fabric conditioning compositions may also include an agent which produces a pearlescent appearance, eg an organic pearlising compound such as ethylene glycol distearate, or inorganic pearlising pigments such as microfine mica or titanium dioxide ($TiO_2$) coated mica.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients include non-aqueous solvents, perfume carriers, fluorescers, colourants, hydrotropes, antifoaming agents, antiredeposition agents, enzymes, optical brightening agents, opacifiers, anti-shrinking agents, anti-wrinkle agents, anti-spotting agents, dye transfer inhibitors, germicides, fungicides, anti-oxidants, UV absorbers (sunscreens), heavy metal sequestrants, chlorine scavengers, dye fixatives, anti-corrosion agents, drape imparting agents, antistatic agents and ironing aids. This list is not intended to be exhaustive.

The amount of the anionic polymer in the composition of the invention preferably ranges from 0.01 to 35% by weight, more preferably 0.01 to 10%, most preferably 0.05 to 5%. The amount of anionic polymer deposited on the fabric in the invention preferably ranges from 0.0005% to 5% by weight of resin based on weight of fabric (owf), more preferably 0.001% to 2% owf.

Certain fabric care compositions of the invention in which the exhaustion agent is a quaternary ammonium compound have surporisingly good stability. Aqueous compositions containing an anionic polymer and a cationic exhaustion agent of this type could reasonably have been expected to be unstable and to form a precipitate or gel. Furthermore, compositions containing the quaternary ammonium compound and the anionic polymer can have a pearlescent appearance which may be desirable in certain product applications In another embodiment, the present invention provides a method of treating a fabric, as part of a laundering process, which comprises applying to the fabric a composition of the invention. Preferably, the composition is applied to the fabric during the rinse cycle of a conventional laundering process, more preferably after application of a detergent composition to the fabric. The laundering process may be a domestic laundering process.

In a further embodiment, the invention relates to the use of an anionic polymer which is capable of self cross-linking and/or of reacting with cellulosic fibres in a laundering process to increase the dimensional stability of a fabric which comprises cellulosic fibres.

The invention also relates to the use of an anionic polymer which is capable of self cross-linking and/or of reacting with cellulosic fibres to improve the surface colour definition of a fabric after washing, wherein the fabric comprises cellulosic fibres.

Further provided by the invention is the use of an anionic polymer which is capable of self cross-linking and/or of reacting with cellulosic fibres to impart a softer handle to a fabric which comprises cellulosic fibres.

Additionally, the invention provides the use of an anionic polymer which is capable of cross-linking and/or of reacting with cellulosic fibres in a laundering process to improve the crease recovery properties of a fabric which comprises cellulosic fibres.

In the latter four embodiments of the invention, the anionic polymer is preferably of formula (I), as defined above. Preferably, in formula (I), m is equal to 1. Conveniently, Y is —CH—NH—$(CH_2)_p$—NH—CO— and, preferably, p is from 4 to 8, such as about 6. It is also preferred that n is 10 to 15, such as about 13 for example. M is advantageously sodium or potassium, more preferably sodium.

The anionic polymer in the latter four embodiments of the invention may be formulated in any suitable form for fabric treatment. Where the anionic polymer is for use in a laundering system, it may be in the form of a composition for use in any stage of the laundering process. For example, the composition may be a pre-wash treatment, a main wash detergent composition, a rinse applied composition (such as a fabric conditioning composition or a rinse adjunct) or it may be formulated for application to a fabric before, during or after tumble drying such as by delivery from a suitable dispenser or from a flexible sheet or it may be formulated as an ironing aid. If the composition is a rinse applied composition, it may be a fabric care composition of the invention.

Although applicable to fabrics containing any type of cellulosic fibres, the present invention provides particular advantages for fabrics which comprise cotton or regenerated cellulose such as viscose, especially cotton. The fabric may be in the form of a garment. The fabrics may contain 50% to 100% cotton, such as 75% to 100% cotton, for example. If the fabrics do not contain 100% cotton, the balance may be made up of fibres conventionally used in garments such as of polyester and polyamide, for example.

The invention will be illustrated by the following non-limiting examples.

EXAMPLES

Example 1

A composition of the invention (Example 1) was prepared by adding 2% by weight SYNTHAPPRET BAP (trade mark) anionic polymer (Bayer) to 55 ml of a standard fabric conditioner composition (Comfort®, Unilever, UK).

The composition of the invention was applied to a 1.25 kg load containing printed woven cotton fabric in the final rinse of a fully loaded automatic washing machine wash cycle (40° C. cotton wash in a Miele Novotronic W820 (trade mark) front loading washing machine).

Red and black coloured regions of the cotton fabric were assessed for the chance in colour after three washing cycles, relative to new fabric ie, as purchased and before washing.

Control tests were carried out using: (a) no rinse treatment; (b) conventional Comfort® fabric conditioner only; and (c) anionic polymer SYNTHAPPRET BAP (trade mark) only.

The overall results (an average of the results for 4 samples) are as follows:

(i) Red regions

| | Treatment | -E* |
|---|---|---|
| (a) | None | 8.59 |
| (b) | Conventional conditioner | 8.77 |
| (c) | Anionic polymer only | 8.37 |
| (d) | Composition of the invention (Example 1) | 8.37 |

*Change in colour relative to new fabric measured using a Spectraflash (trade mark) photometer (ii) Black regions

| | Treatment | -E* |
|---|---|---|
| (a) | None | 6.99 |
| (b) | Conventional conditioner | 7.94 |
| (c) | Anionic polymer only | 7.28 |
| (d) | Composition of the invention (Example 1) | 6.33 |

*Change in colour measured as for (i)

Thus, an improvement in the colour of the fabric after washing was observed with the composition of the invention relative to conventional conditioner and anionic polymer used alone. Furthermore, the fabric treated with the composition of the invention was observed to have as good a handle as fabric treated with the conventional conditioner.

Example 2

The product of Example 2 was prepared by mixing 190 g of Comfort Concentrate (trade mark) and 20 g of SYNTHAPPRET BAP (trade mark). This gives a composition having a product activity of 17.9% comprising 13.1% Comfort (trade mark) and 4.76% SYNTHAPPRET BAP (trade mark).

The product was applied five times to printed woven cotton fabric at a level of 0.2% active per wash during the rinse cycle of a conventional domestic laundry process (400C. cotton wash, Zanussi (trade mark) washing machine). After each wash the load was tumble-dried (Miele Novotronic (trade mark) tumble dyer).

After completion of the fifth wash, the colour of the print was measured on a spectroflash (trade mark) spectrometer.

The colour measurements were:

Black regions:

| | ΔL** | Standard Deviation |
|---|---|---|
| Untreated | 9.17 | 1.30 |
| Comfort | 10.11 | 0.46 |
| SYNTHAPPRET BAP | 8.31 | 0.61 |
| Example 2 | 6.02 | 0.75 |

**Change in lightness relative to new fabric; ΔE and ΔL are almost identical for the black regions.

Again, the fabric treated with the composition of the invention had better surface colour definition, and overall appearance, than fabric treated with the conventional conditioner or the anionic polymer alone. The fabric treated with the composition of the invention was observed to have at least as good a handle as fabric treated with the conventional conditioner in spite of the fact that less of the active component of the fabric conditioning composition is present in the composition of the invention.

What is claimed is:

1. A fabric care composition adapted for use in a laundering process, comprising:

a) an anionic polymer which is capable of self cross-linking and/or of reacting with cellulosic fibres and further comprising;

b) a fabric conditioning agent which acts as a textile compatible exhaustion agent for the anionic polymer;

c) wherein the polymer is selected from carbamoyl sulphonate terminated poly(ether)urethane resins, bunte salt terminated polymers and mixtures thereof having formula (I):

$$CH_2—O[CH_2CH(CH_3)—O]_n—Y—SO_3^-M^+$$

$$[CH—O[CH_2CH(CH_3)—O]_n—Y—SO_3^-M^+]_m$$

$$CH_2—O[CH_2CH(CH_3)—O]_n—Y—SO_3^-M^+{}_m$$

wherein: Y is a divalent radical selected from $—CH_2—CH(OH)—CH_2—S—$ and $—CO—NH—(CH_2)_pNH—CO—$ m is an integer from 0 to 4;

n is an integer from to 20;

M is an alkali metal: and p is an integer from 2 to 12: and d) wherein the exhaustion agent is a quaternary ammonium compound.

2. A composition as claimed in claim 1, wherein the quaternary ammonium compound is 1,2-bis-[hardened tallowoyloxy]-3-trimethylammonium propane chloride.

3. A composition as claimed in claim 1, which is a fabric softening composition, conditioning composition, or blend thereof.

4. A composition as claimed in claim 1 which further comprises a perfume.

5. A method of treating a fabric, as part of a laundering process, which comprises applying to the fabric a composition according to claim 1.

6. A method as claimed in claim 5, wherein the fabric comprises cellulosic fibres.

7. A composition as claimed in claim 1, wherein m is 1, Y is —CO—NH—$(CH_2)_6$—NH—CO—, and M is sodium.

* * * * *

UNITED STATES PATENT AND TRADEMARK OFFICE

CERTIFICATE OF CORRECTION

PATENT NO. : 6,793,684 B1
DATED : September 21, 2004
INVENTOR(S) : Jarvis et al.

It is certified that error appears in the above-identified patent and that said Letters Patent is hereby corrected as shown below:

Column 8,
Line 60, change "$[CH–O[CH_2CH(CH_3)–O]_n–Y–SO_3–M^+]^m$" to
-- $[CH–O[CH_2CH(CH_3)–O]_n–Y–SO_3–M^+]_m$ --
Line 62, change "$CH_2–O[CH_2CH(CH_3)–O]_n–Y–SO_3^-M^{+m}$" to
-- $CH^2–O[CH_2CH(CH_3)–O]_n–Y–SO_3^{-M+}$ --

Column 9,
Line 1, change "n is an integer from to 20;" to -- n is an integer from 5 to 20; --

Signed and Sealed this

Twenty-eighth Day of December, 2004

JON W. DUDAS
*Director of the United States Patent and Trademark Office*